United States Patent [19]

Mori et al.

[11] Patent Number: 4,622,533

[45] Date of Patent: Nov. 11, 1986

[54] SELF-RECOVERY TYPE CURRENT LIMITING ELEMENT

[75] Inventors: Sadao Mori; Tsuruo Yorozuya, both of Chofu; Yuichi Wada, Kawanishi; Yasuhide Shinozaki, Takarazuka, all of Japan

[73] Assignee: Mitsubishi Denki Kabushiki Kaisha, Japan

[21] Appl. No.: 725,498

[22] Filed: Apr. 22, 1985

[30] Foreign Application Priority Data

Apr. 24, 1984 [JP] Japan ..... 59-82517

[51] Int. Cl.[4] ..... H01H 37/36; H01H 61/00

[52] U.S. Cl. ..... 337/114; 337/158

[58] Field of Search ..... 337/114, 158

[56] References Cited

FOREIGN PATENT DOCUMENTS 2403354 8/1974 Fed. Rep. of Germany ..... 337/114

*Primary Examiner*—Harold Broome

*Attorney, Agent, or Firm*—Leydig, Voit & Mayer, Ltd.

[57] ABSTRACT

A self-recovery type current limiting element for suppressing overcurrent conditions and capable of recovering so as to be operated under normal current conditions including two identical element cylinders coupled therebetween by a coupler. A series of annular insulating members are provided within the element cylinders and include through holes for current limiting material providing a current limiting path extending longitudinally of each cylinder from an entrance opening at one end connected to the coupler to a buffer at the other end. The through holes in certain members nearer the coupler have a cross-sectional area smaller than the other annular members in the respective cylinders, providing a constricted region of the path. The current limiting material vaporizes when heated by current overload so as to increase resistance to suppress the current passing through. Current overload causes vaporization to start near the coupler at the constricted region of the path and to proceed axially such that heat dissipates the full length of each cylinder. The limiting material returns to its normal state to ensure normal operation.

8 Claims, 4 Drawing Figures

SELF-RECOVERY TYPE CURRENT LIMITING ELEMENT

BACKGROUND OF THE INVENTION

The present invention relates to a self-recovery type current limiting element for suppressing an abnormally large current such as a shortcircuiting current in an overcurrent condition and for allowing a normal current to flow under normal conditions before and after the overcurrent condition.

A conventional current limiting element of this type is as shown in FIG. 1. In FIG. 1, numerals 1 and 2 designate first and second current terminals, numeral 3 an electrode, numerals 4 and 5 first and second pistons, numerals 6, 7, 8, 9 and 10 seal rings, numerals 11 and 12 annular insulating members, numeral 13 a special insulator, numeral 14 an outer cylinder, numeral 15 a clamp, and numeral 16 a current limiting material. Numerals 17 and 18 designate buffers forming pressure buffer units of the current limiting material 16 together with pistons 4 and 5, numeral 19 a spacer, numeral 20 an intermediate spacer, numerals 21, 22 and 23 sealers, and numeral 24 an element cylinder.

The first and second current terminals 1 and 2 are formed, for example, of a conductive material such as a chromium copper or a beryllium copper. The terminal 1 is engaged with the electrode 3, and the terminal 2 is engaged with the cylinder 14. Reference character 2*a* denotes a through hole formed at the terminal 2. The electrode 3 is formed, for example, of a conductive material such as chromium copper or a beryllium copper. Reference character 3*a* depicts a through hole formed at the electrode 3. The pistons 4 and 5 are respectively provided in the through holes 3*a* and 2*a*. The annular members 11 and 12 are formed of an insulating material such as beryllia procelain and alumina porcelain. The outer cylinder 14 is respectively associated with a plurality of annular insulating members 11 and 12 via through holes 11*a* and 12*a* connecting the intermediate spacers 20. The current limiting material 16 such as sodium, potassium, NaK formed of a sodium and potassium alloy or mercury (Hg) is provided to fill in through holes 11*a* and 12*a*, part of the through hole 3*a* of the electrode 3 and part of the through hole 2*a* of the terminal 2. The insulator 13 is formed of solid material produced, for example, by powders of mica and glass and having a thermal expansion coefficient larger than that of the cylinders 11 and 12 and a large mechanical strength such as stainless steel. The clamper 15 prevents the electrode 3 from being removed through the insulator 13 which is filled in the outer cylinder 14 and covers the electrode 3. The element cylinder 24 and the second current terminal 2 are individually formed, and then connectedly associated.

A method of manufacturing the element cylinder 24 is referred to as the so-called "molding". This method includes the steps of first allowing the insulator 13 to be press-fitted over the electrode 3, the insulating cylinders 11 and 12, the intermediate spacer 20, and the clamp 15 and then permitting the spacer 19 to be cooled to the ambient temperature. Thus, radial and axial compression forces due to thermal expansion of the current limiting material 16 filled in the through holes can be applied to the cylinders 11, 12 at differnt strength levels. Another so-called "molding by shrinkage-fitting" method is carried out to form part of a vessel sufficiently durable against high internal pressure. The buffers 17 and 18 are formed of compressive fluid such as argon or nitrogen and a mechanically elastic material such as a coil spring or a leaf spring. The spacers 20 and 19 are formed, for example, of copper or chromium copper, and composed of a material having high thermal conductivity to prevent the insulating cylinders from 11, 12 being damaged by "molding by shrinkage-fitting" method and to improve the heat dissipation. The sealer 21 seals a filling port receiving the material 16. The sealers 22 and 23 respectively seal the filling ports of the buffers 17 and 18.

As shown in FIG. 1, the cross-sectional area of the through holes 11*a* of the annular members 11 smaller than that of the through holes 12*a* of annular member 12 os as to satisfy various electrical performance of the current limiting material 16.

The operation of the conventional current limiting element is as follows. As a normal (rated) current flows along a path connecting the first terminal 1 through the electrode 3 and the current limiting material 16 to the second terminal 2, the current limiting material 16 generates Joule heat and changes into the solid or liquid state depending on the temperature of the generated heat and the heat dissipations in radial direction from the members 11 and 12, and in axial direction from the insulator 12.

When an overcurrent such as a shortcircuiting current flows across the current limiting element, the material 16 in the through holes 11*a* of the member 11 due to its small cross-sectional area is first vaporized. The material 16 in the through holes 12*a* of the member 12 having a larger cross-sectional area is subsequently vaporized sequentially to become a plasma state of high temperature, pressure and resistance, thereby suppressing (limiting) the overcurrent to a predetermined value or lower. The members 11 and 12 having heat resistance disposed around the material 16 coupled with the insulation from the insulator 13 endure against the high temperature occurred by the plasma state of the material 16 so as to force the pistons 4 and 5 on both sides to move against the high pressure which is absorbed by the compressing operations of the buffers 17 and 18. The members 11, 12 and the insulator 13 further endure against the voltage generated between the current terminals 1 and 2 due to the high resistance of the material 16 when a short occurs.

As can be seen, the current limiting element can only limit the overcurrent by suppressing it to a lower current, but cannot trip the circuit by interruption. However, the element is interrupted by a switch (not shown) provided, for example, in series. After the suppressing operation, the material 16 is then cooled by the heat dissipation, and recovered to the liquid or solid state by the returning pressures from the buffers 17 and 18 via pistons 4 and 5 to allow a normal load current to flow across. In other words, the element has a reenergizing performance.

In the case of FIG. 1, since the vaporization of the current limiting material 16 starts from the insulating member 11 which are in the center and at the farthest distance from the pistons 4 and 5 and then advances to the other portions of the through holes of the members 12, these portions of the through holes of the members 11 and 12 cannot be effectively utilized for the current limiting action.

Further, the pistons 4 and 5 not only operate the pressure buffers 17 and 18 for the reenergizing performance after the overcurrent suppression, but also apply compressing force to the material 16 even when volumetric change occurs due to the variation in the phase from solid to liquid of the material 16 creating air gaps in the cylinders 11 and 12 which will substantially degrade the reenergizing performance of the current limiting element.

Since the conventional current limiting element of the construction described above generally has, however, small thermal conductivity of the special insulator 13, its possible radial heat dissipation amount is small. Thus, the heat dissipation mainly depends upon the axial heat dissipation through the members 11 and 12. In the event that it is necessary to enhance the voltage across the limiting element, the cylinders 11 are positioned between cylinders 12 to further increase the axial length of the element. This allows the material 16 increase its Joule heat generation. It is further noted that as the temperature increases, the reenergizing performance decreases. In addition, the conventional current limiting element has such a drawback that, when the axial length of the members 11 and 12 are increased as described above, long outer cylinder 14 is required, and the manufacture of the cylinder 14 becomes difficult, with the result that the cost increases.

SUMMARY OF THE INVENTION

It is therefore an object of the present invention to overcome such deficiency of the conventional current limiting element. More particularly, the present invention provides a self-recovery type current limiting element in which two element cylinders containing annular insulating members being filled with a current limiting material and having a compressing mechanism are coupled by a coupling device at opposite sides of the cylinders. Thus, the current limiting element can be inexpensively manufactured, and the reenergizing performance of the limiting element can be improved.

BRIEF DESCRIPTION OF THE DRAWINGS

In the drawings, the same reference numerals denote the same or corresponding portions.

DESCRIPTION OF THE PREFERRED EMBODIMENTS

Figure 1:
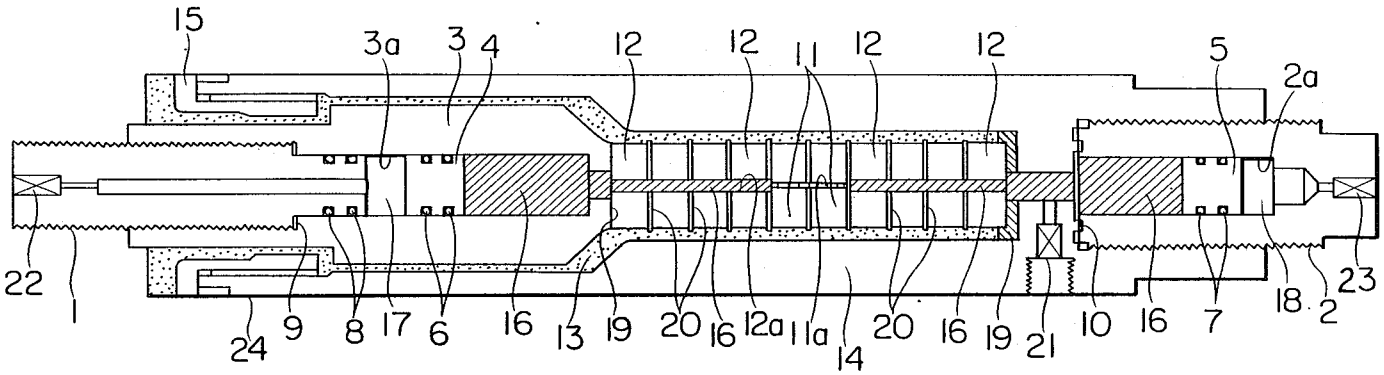
FIG. 1 PRIOR ART
FIG. 1 is a sectional view showing a conventional self-recovery type current limiting element.
Figure 2:
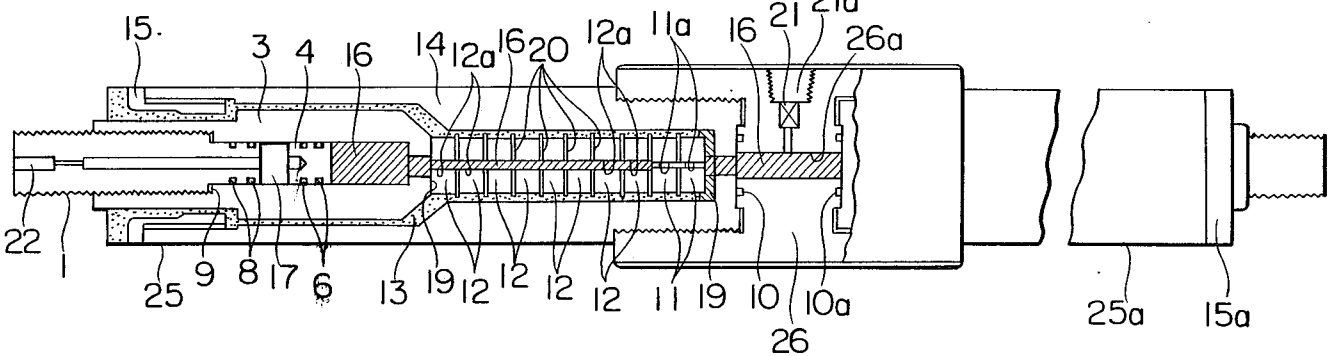
FIG. 2 is a sectional view showing a self-recovery type current limiting element according to an embodiment of the present invention.

FIG. 2 shows an embodiment of the present invention. A first element cylinder 25 is provided on the left side and is connected to a second element cylinder 25*a*, shown diagrammatically on the right side through a coupler 26. It is noted that these two elements 25 and 25*a* are identical and similar to the element cylinder 24 except in the disposition of an annular insulating member 11 having a through hole 11*a* of a small sectional area and an annular insulating member 12 having a through hole 12*a* of a large sectional area. As seen in FIG. 2, the cylinders 11 are positioned at the right end of the cylinders 12. Further, the second current terminal 2 shown in FIG. 1 is not provided in this element cylinder. The coupler 26 is electrically and mechanically formed in an integral structure relative to the two element cylinders 25 and 25*a*. The coupler 26 is preferably formed of a material having high thermal conductivity and large mechanical strength such as a conductive material, e.g., chromium copper or beryllium copper, or an insulating material, e.g., beryllia porcelain or alumina porcelain.

The coupler 26 has a through hole 26*a* for connecting the current limiting material 16 of the first element cylinder 25 and the current limiting material 16 of the second element cylinder 25*a*. A filling port 21*a* is further provided to supply the current limiting material 16 to the two element cylinders 25 and 25*a*. The material 16 is sealed by a sealer 21 provided in the port 21*a*. The material 16 is sealed through the engagement of the coupler 26 with the element cylinders 25 and 25*a* via seal rings 10 and 10*a*. When an overcurrent such as a shortcircuiting current occurs, the material 16 starts vaporizing in the through hole 11*a* near the coupler 26 and proceeds and vaporizes axially in the through hole 12*a* having large sectional area such that heat dissipates the full length of each cylinder. Thus, all portions of member 11 and 12 which contribute to the current limiting operation can be effectively utilized.

As noted above, the element cylinder 25 is different from the element member 24 in FIG. 1 in the construction that the cylinder 11 having the through hole 11*a* of small sectional area is disposed near the coupler 26. The through hole 11*a* generates large heat amount, and the element cylinder 25 can provide much larger heat dissipating effect than the element cylinder 24 in FIG. 1 by the abovementioned disposition. Therefore, if the flowing currents are equal, the temperature rise of the material 16 becomes low, and the generated heat amount decreases. On the contrary, if the temperature rises of the materials 16 are equalized, it means that large flowing current can be allowed.

As apparent from FIG. 2, in the embodiment described above, a pair of element cylinders 25 and 25*a* are disposed oppositely through the coupler 26. Therefore, the size of this element cylinders can be reduced shorter than the disposition of two conventional current limiting elements shown in FIG. 1. Further, the heat can be effectively dissipated by the coupler 26. Consequently, the current limiting element can be used to be adapted for a high voltage electric circuit.

In the embodiment described above, the room in which the current limiting materials 16 are sealed is commonly constructed for both the element cylinders 25 and 25*a*. Therefore, only one filling port 21*a* is sufficient, and the filling work of the manufacturing process can be shortened.

In addition, in the embodiment described above, the sectional area of the through hole 26*a* of the coupler 26 is formed larger than the through holes 11*a* and 12*a* of the annular insulating members 11 and 12 to retain the current limiting material 16 therein, thereby utilizing the current limiting material itself in the through hole 26*a* utilizing the compressibility of the material 16 as a pressure buffer. Further, since compression force is affected so as not to produce air gaps in the through holes 11*a* and 12*a* by the current limiting materials being expanded after the current limiting operation, it can largely effect the recovery and stabilization of the resistance after the current limiting operation of the current limiting element.

Figure 3:
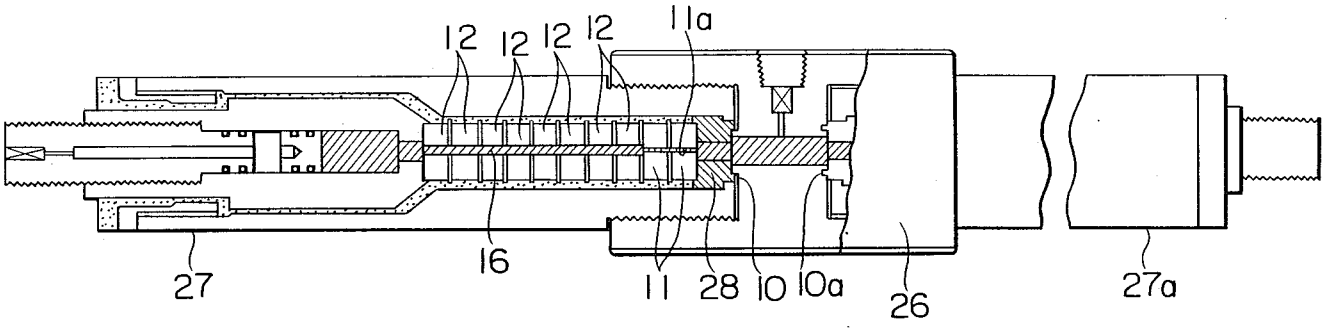
FIG. 3 is a sectional view showing a self-recovery type current limiting element according to another embodiment of the present invention.

FIG. 3 shows another embodiment of the present invention. A spacer 28 of an element cylinder 27 is formed of a material having large thermal conductivity such as chromium copper. The spacer 28 is connected at its one end directly to the annular insulating member 11, and at its other end directly to the coupler 26. This construction is different from the embodiment in FIG. 2. The insulating member 11 has a through hole 11*a* including large heat generation amount, while the coupler 26 is composed of a material having preferable heat dissipation and conductivity such as chromium copper. Thus, the heat generated from the members 11 and 12 can be effectively transmitted to the coupler 26 and dissipated externally. Therefore, as compared with that in FIG. 2, the heat dissipating effect can be further enhanced, thereby providing a current limiting element adapted for a high voltage.

Figure 4:
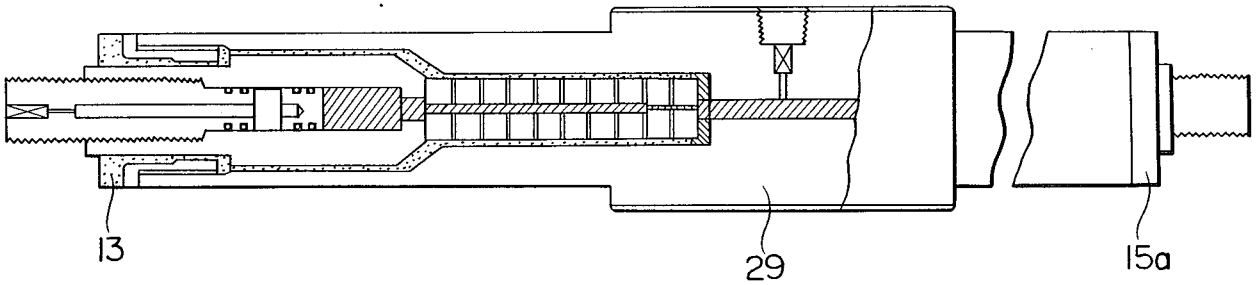
FIG. 4 is a sectional view showing a self-recovery type current limiting element according to still another embodiment of the present invention.

FIG. 4 shows still another embodiment of the present invention. More particularly, the outer cylinder 14 and the coupler 26 shown in FIG. 2 are integrated as an integral outer cylinder 29. Thus, since the element cylinder can be formed at once, the working time for manufacturing the element cylinder can be shortened. Further, when the cylinder 29 is formed of a material having large thermal conductivity such as chromium copper, its axial heat dissipation effect can be remarkably improved. In addition, its radial heat dissipation can be improved as compared with the case of the outer cylinder 14 formed of stainless steel shown in FIG. 1. As a result, the energizing effect can be largely improved.

In the embodiments described above, the first and second element cylinders 25 and 25*a* are coupled on the same rectilinear line, for example, in the embodiment shown in FIG. 2. However, the cylinders 25 and 25*a* may not always be coupled on the same rectilinear line, but the function of the current limiting element is not lost even if the center line of the element cylinders 25 and 25*a* is formed, for example, at a right angle (L shape) or in a folded shape (U shape). In other words, the cylinders 25 and 25*a* may be formed at a suitable angle with respect to the relationship to the installing place.

In the embodiments described above, the heat dissipating effect can be further improved by providing heat dissipating fins on the outer peripheries of the element cylinders 25 and 25*a*, and the coupler 26.

What is claimed is:

1. A self-recovery type current limiting device for suppressing overcurrent conditions and capable of recovering so as to be operated under normal conditions, said device comprising: current limiting material;

a pair of cylinders;

a plurality of annular insulating members coaxially arranged along the axis of each cylinder and having interconnected through holes filled with said current limiting material to form an axial current limiting path extending longitudinally through the respective cylinder;

an entrance opening in one end of each cylinder and a buffer in the axial current limiting path at the other end of each cylinder;

a coupler connected to the one end of each cylinder, said coupler having a filling passage extending to the entrance opening of each cylinder and an exterior filling port connected to said filling passage for filling the interconnected through holes in said insulating members in each cylinder and said filling passage with said current limiting material; and means constricting a region of the path in each cylinder near the coupler including certain of said annular members in each cylinder disposed in the region nearer the entrance opening having through holes of a smaller cross-sectional area than the other annular members in the respective cylinder for causing vaporization of said current limiting material in response to current overload to start near the coupler in the constricted region and to proceed axially away from the coupler along the path through each cylinder to dissipate heat radially progressively the full length of each cylinder.

2. A device according to claim 1, said coupler including means for holding said cylinders so that said cylinders extend in opposite longitudinal directions from the coupler.

3. A device according to claim 1, said coupler holding said cylinders so that said cylinders extend at right angles to each other.

4. A device according to claim 1, said coupler holding said cylinders to that said cylinders and said coupler having a U-shape.

5. A device according to claim 1, at least one of said cylinders and said coupler being made of high thermal conductivity chromium copper.

6. A device according to claim 1, each cylinder having a thermally conductive spacer between the one end of the respective cylinder and said certain of said annular insulating members disposed near the entrance opening.

7. A device according to claim 6, said thermally conductive spacer having a higher thermal conductivity than said insulating members.

8. A device according to claim 7, said thermally conductive spacer being formed of chromium copper.

* * * * *